US005482518A

United States Patent [19]

Poirier

[11] Patent Number: 5,482,518

[45] Date of Patent: Jan. 9, 1996

[54] SYNERGISTIC CETANE IMPROVER COMPOSITION COMPRISING MIXTURE OF ALKYL-NITRATE AND HYDROPEROXIDE QUINONE

[75] Inventor: Marc-Andre Poirier, Sarnia, Canada

[73] Assignee: Exxon Research and Engineering Company, Florham Park, N.J.

[21] Appl. No.: 341,711

[22] Filed: Nov. 18, 1994

[51] Int. Cl.[6] ..... C10L 1/22; C10L 1/18

[52] U.S. Cl. ..... 44/312; 44/322; 44/326

[58] Field of Search ..... 44/312, 326, 322, 44/349, 437

[56] References Cited

U.S. PATENT DOCUMENTS

| | | | |
|---|---|---|---|
| 2,107,059 | 2/1938 | Moser | 44/349 |
| 2,210,942 | 8/1940 | Lipkin | 44/437 |
| 2,580,015 | 12/1951 | George | 44/322 |
| 2,582,192 | 1/1952 | Denison, Jr. | 44/322 |
| 2,912,313 | 11/1959 | Hinkamp et al. | 44/322 |
| 4,330,304 | 5/1982 | Gorman . | |
| 4,365,973 | 12/1982 | Irish . | |
| 4,536,190 | 8/1985 | Seemuth . | |
| 4,585,461 | 4/1986 | Gorman . | |
| 4,592,761 | 6/1986 | Zaweski et al. | 44/326 |
| 4,992,605 | 12/1991 | Craig et al. | 585/240 |
| 5,114,433 | 5/1992 | Dubreux et al. | 44/322 |
| 5,258,049 | 11/1993 | Liotta, Jr. | 44/324 |

FOREIGN PATENT DOCUMENTS

| | | | |
|---|---|---|---|
| 0293069 | 11/1988 | European Pat. Off. . | |
| 0467628 | 1/1992 | European Pat. Off. . | |
| 0537931 | 4/1993 | European Pat. Off. . | |
| 2227751 | 8/1990 | United Kingdom . | |
| 2227752 | 8/1990 | United Kingdom . | |
| 9308244 | 4/1993 | WIPO | C10L 1/22 |

OTHER PUBLICATIONS

ACS, 77: 24850, 1995.

"How Do Diesel Fuel Ignition Improvers Work" Clothier, et al. Chem Soc Rev 1993 pp. 101–108 (no month available).

"Reaction of Hindered Phenols II—Base Catalyzed Oxidation of Hindered Phenols" Kharasch et al. J. Org Chem 22 Nov. 1957, 1439–1443.

"Performance and Stability of Some Diesel Fuel Ignition Quality Improvers".

Robbins, et al., SAE Quarterly Transactions, Jul. 1951, vol. 5 No. 3 pp. 404–416.

*Primary Examiner*—Margaret Medley

*Attorney, Agent, or Firm*—Joseph J. Allocca

[57] ABSTRACT

A fuel additive composition comprising an alkylnitrate such as a nitrate ester and hydroperoxide quinone which synergistically improves the cetane of diesel fuels and other middle distillate fractions, excluding jet.

9 Claims, No Drawings

SYNERGISTIC CETANE IMPROVER COMPOSITION COMPRISING MIXTURE OF ALKYL-NITRATE AND HYDROPEROXIDE QUINONE

BACKGROUND OF THE INVENTION

1. Field of the Invention

This invention relates to diesel and middle distillate fractions excluding jet and to additives used for improving the cetane number of such fractions.

2. Description of Related Art

Fuel ignition in diesel engines is achieved through the heat generated by air compression, as a piston in the cylinder moves to reduce the cylinder volume during the compression stroke. In the engine, the air is first compressed, then the fuel is injected into the cylinder; as the fuel contacts the heated air, it vaporizes and finally begins to burn as the self-ignition temperature is reached. Additional fuel is injected during the compression stroke and the fuel burns almost instantaneously, once the initial flame has been established. Thus, a period of time elapses between the beginning of fuel injection and the appearance of a flame in the cylinder. This period is commonly called "ignition delay" and must be relatively short in order to avoid "diesel knock". A major contributing factor to diesel fuel performance and the avoidance of "diesel knock" is the cetane number of the diesel fuel. Diesel fuels of higher cetane number exhibit a shorter ignition delay than do diesel fuels of a lower cetane number. Therefore, higher cetane number diesel fuels are desirable to avoid diesel knock. Most diesel fuels possess cetane numbers in the range of about 40 to 55 and a sulfur content of about 500 ppm and less. A good correlation between ignition delay and cetane number has been reported in "How Do Diesel Fuel Ignition Improvers Work" Clothier, et al., Chem. Soc. Rev, 1993, pg. 101–108 in the region $3 \leqq t\ igni \leqq 8$ m sec using the equation CN=91–6.4 t igni, which reflects contributions by engine timing and levels of additives in the fuel. Correcting the equation to remove the influences of timing and additives results in the equation CN=8.5–6.0 t igni, which formula was used to calculate the cetane indices reported in this specification.

Cetane improvers have been used for many years to improve the ignition quality of diesel fuels. The use of cetane improvers is increasing due to the increased demand for diesel fuel which has resulted in a widening of the fraction recovered, the so called middle distillate fraction, and the lower natural cetane number of diesel base stocks caused by more severe refining of crude oil and the effort made to produce low emission diesel.

Many types of additives have been prepared and evaluated to raise the cetane number of diesel fuel. Such additives include peroxides, nitrates, nitrites, azo compounds and the like.

Alkyl nitrates such as amyl nitrate, hexyl nitrate and mixed octyl nitrates have been used commercially with good results. Other nitrates such as 2-methyl-2-nitropropyl nitrate (U.S. Pat. No. 4,536,190) have been suggested as cetane improvers but found shock sensitive. However, it is generally accepted that organic nitrates, more specifically the commercial 2-ethylhexyl nitrate, are the most cost-effective additives to improve cetane number of diesels. Because of its relatively low cost, and environmentally friendly nature (ashless), there has been limited work done in this area to replace the 2-ethylhexyl nitrate.

U.S. Pat. No. 4,992,605 discloses a process for producing high cetane hydrocarbons in the diesel boiling range, by hydroprocessing tall oil or vegetable oils such as canola, sunflower, soybean and rapeseed oil at temperatures in the range from 350° C. to 450° C. and pressures of 4.8 to 15.2 MPa. The hydrocarbons mixture produced by this process has a relatively high cetane number (50–85 CN), however, relatively high levels (10–15%) are required to increase the cetane number of the diesel fuel by about 3 to 5 cetane numbers. Moreover, because of the waxy nature of the material, it has relatively high cloud point (4°–16° C.) which limits its usefulness to blending into summer diesel.

U.S. Pat. No. 4,585,461 refers to a method of manufacturing a cetane improver fusel oil, a waste product from the distillation of alcoholic beverages. Fusel oil provides a cheap source of ethyl alcohol (5 to 25%), isobutyl alcohol (16 to 33%) and isoamyl alcohol (30 to 77%). However, it is mentioned that fusel oil is foul smelling, quite toxic and one of the alcohol is a teratogen. Moreover, lower molecular weight nitrates such as ethyl nitrate or amyl nitrate, tend to be explosive in inverse proportion to their molecular weight. Such materials are hazardous if their molecular weight is 76, but decreasingly as their weight reaches 174. "Fusel" nitrate has a molecular weight of 119 and is moderately hazardous.

Organic nitrates and organic peroxides are well known to cause substantial increases in cetane number of diesel fuels. It is generally accepted that organic nitrates, more specifically the commercial 2-ethylhexyl nitrate (DII-3 sold by Ethyl Petroleum Additives), are the most cost-effective additives to improve the cetane number of diesel fuels.

Clothier et al in "How Do Diesel Fuel Ignition Improvers Work" Chem. Soc. Rev. 1993, pg 101–108 have reported that the ignition delay using half-and-half mixture of 2-ethylhexyl nitrate and di-tert-butyl peroxide was not better than using either additive on its own. Similar results to those reported by Clothier have been obtained with tert-butyl perbenzoate and 2-ethylhexyl nitrate in Example 2 herein.

G.B. Patent 2,227,752A teaches that cetane number of a hydrocarbon-based fuel is increased by the addition of a minor amount of a parketal of the formula $R_2R_3C(OOR_1)_2$ wherein $R_1$ is a $C_4$–$C_{10}$ tertiary alkyl group and $R_2$ and $R_3$ together with the attached C atom form a cycloalkane ring optionally substituted by one or more $C_1$–$C_4$ alkyl radicals or other essentially inert substituents. The perketal is not used in combination with an alkyl nitrate.

More recently EP0537931 discloses a fuel composition for reducing emissions on combustion consisting of a middle distillate fuel, organic nitrate combustion improver and a tert-alkyl peroxyalkanoate or peroxybenzoate.

U.S. Pat. No. 5,114,433 describes a process for improving the cetane number of a directly distilled diesel fuel by intimately contacting same with hydrogen peroxide in the presence of carboxylic acid or with a percarboxylic acid in the presence or absence of hydrogen peroxide.

G.B. Patent 2,227,751A discloses a hydrocarbon-based fuel to which has been added a minor amount, sufficient to increase the cetane value of the fuel, of a perester of the formula $R_1COOOR_2$ where $R_1$ is a $C_5$–$C_{20}$ secondary or tertiary alkyl group and $R_2$ is a $C_4$–$C_{10}$ tertiary alkyl group.

U.S. Pat. No. 4,365,973 discloses a middle distillate fuel additive composition to improve cold flow properties, cetane, pour point, wax formation and anti-icing characteristics and comprising a cold flow improver, preferably vinyl acetate-ethylene copolymer, a cetane improver comprising paraffinic nitrate or a mixture of nitrates and an anti-icer comprising an aliphatic alcohol or cyclic aliphatic alcohol having from 1 to 6 carbon atoms.

EP 467,628 discloses a middle distillate composition to reduce atmospheric pollutants (NOx, CO and/or hydrocarbons). The fuels incorporate a peroxy ester combustion improver of the formula $(R—O—O—(CO))_n R^1$ where R and $R^1$ are both hydrocarbyl groups. Suitable peroxy esters include tert-butyl peroxydodecanoate, di-(tert-butyl-diperoxy) phthalate and 1,1-dimethylpropylperoxy benzoate. The peroxy ester is used in combination with an organic nitrate ester such as 2-ethylhexyl nitrate.

U.S. Pat. No. 4,330,304 discloses a fuel additive for improving the combustion efficiency of fuels for diesel engine, jet engines, boiler and other apparatus. The additive comprises a hydroperoxide such as cumene hydroperoxide, a nitroparaffin and propylene oxide.

EP 293,069 discloses a cetane improver comprising tetralin hydroperoxide. The cetane improver is produced by partially hydrogenating a naphthalene or alkyl naphthalene-containing hydrocarbon oil to obtain tetralins, which are then partially oxidized to produce a hydrocarbon oil containing tetraline hydroperoxides.

U.S. Pat. No. 5,258,049 discloses a diesel fuel containing the nitric acid ester of 1-phenyl ethanol as cetane improver.

DESCRIPTION OF THE INVENTION

It has been discovered that the cetane number of diesel and other middle distillate fractions excluding jet fuel fractions is improved, to an extent greater than expected based upon the individual cetane improvement abilities of the additives in the amount used, by employing a combination additive comprising a major amount of an alkyl nitrate and a minor amount of a hydroperoxide quinone of the formula

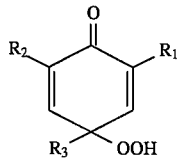

(1)

wherein the alkyl nitrate is a paraffinic nitrate or mixture of paraffinic nitrates, preferably a $C_4$ to $C_{16}$ paraffinic nitrate or mixture thereof. The alkyl nitrate can be butyl nitrate, amyl nitrate, hexyl nitrate, heptyl nitrate, octyl nitrate, their isomers and mixtures thereof, a preferred alkyl nitrate is 2-ethylhexyl nitrate. $R_1$, $R_2$ and $R_3$ of the hydroperoxide quinone of formula 1 are alkyl group containing 1 to 4 carbons, preferably $R_1$ and $R_2$ are tert butyl and $R_3$ is methyl.

The combination additive is present in the fuel in an amount in the range 0.05 to 3 wt %, preferably 0.1 to 2 wt %, most preferably 0.1 to 1 wt %.

The combination additive comprises a major amount of alkyl nitrate and less than 50 wt % of the hydroperoxide quinone, preferably 0.5 to 25 wt % hydroperoxide quinone.

The diesel fuel composition or other middle distillate to fraction, excluding jet, containing the combination cetane improver may also contain other, conventional additives and blending agents including friction modifiers, solubilizers, anti-rust agents, detergents, anti-oxidizing agents, lubricants, heat stabilizers, etc.

The fuel fraction to which the combination additive is added is typically a hydrocarbon based diesel fuel derived from natural petroleum sources and boiling in the about 150° to 370° C. range.

The preparation of hydroperoxide quinones has been reported in "Reactions of Hindered Phenols. II. Base-Catalyst Oxidation of Hindered Phenols", Kharasch et al, J. Org Chem., 22, 1957, pg 1439–1443. A hydroperoxide quinone of formula

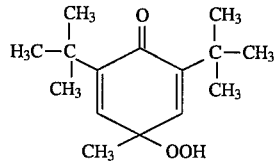

(Formula 2)

(2,6 di-tert-butyl-4-methyl-4-hydroxyperoxy-2,5-cyclohexadiene-1-one) is easily prepared in one step, in high yield, by the oxidation with oxygen of commercially available 2,6-di-tert-butyl-4-methylphenol in the presence of ethanol and caustic.

It has been found that the addition of the combination additive of the present invention to a diesel fuel which additive comprises a major amount of an alkyl nitrate with a minor amount of a hydroperoxide quinone results in an increase in the cetane number of the fuel to a level greater than would be expected based on a mere linear blending of the contributions attributable to each component individually. Thus the combination of alkyl nitrate and hydroperoxide quinone is an unexpectedly synergistic combination.

The benefit of using the combination of alkyl nitrate and hydroperoxide quinone goes beyond that of simply improving the cetane number of diesel fuel in a synergistic, non-linear relation manner. While it is significant that such a synergistic non-linear relationship has been found for the combination, the present invention shows that two chemically different additives, an alkyl nitrate and a peroxide (in this case specifically hydroperoxide quinone), can be used as a combination, thus taking advantage of any unique ignition delay improvement capability attributable to each type of material individually, while permitting the practitioner to still achieve outstanding cetane number improvement normally obtainable only with pure alkyl nitrate.

In the following examples the hydroperoxide quinone used, 2,6-di-tert-butyl-4-methyl-4-hydroperoxy-2,5-cyclohexadiene-1-one (Compound 1), was prepared as follows: 2,6-di-tert-butyl-4-methylphenol (4.4 g 0.02 mole) was dissolved in 50 ml ethanol and a solution of potassium hydroxide (2 g in 5 ml water) was added. Oxygen was bubbled in the solution at 2.7 L/min flow rate for approximately 20 minutes. The solution which had become pale yellow, was immediately poured into ice water (700 ml) and neutralized with acetic acid. The precipitate which separated was collected on a filter, washed with water and dried (4.8 g). Crystallization from n-hexane, gave colorless needles which melted at 115°–116° C. Yield of pure compound I calculated on the basis of the starting compound was 86%.

The present invention is further illustrated in the following non limiting examples.

The cetane number of the diesel fuel samples were determined according to the ASTM D613 method.

The ignition delay was determined on a 1981 Nissan L28 six-cylinder inline 2.8 L gasoline engine, compression ratio 7.5:1 where the rearmost cylinder was modified to operate in a diesel mode. The procedure has been described by P.Q.E. Clothier et al in Combustion and Flame 81,242–250 (1990).

Various diesel fuels were used in this work. The properties of the fuels are described below.

| PROPERTIES | DIESEL FUEL SAMPLE # MAP-2355 | MAP-2272 | MAP-2325 | MAP-2700 |
|---|---|---|---|---|
| Density @ 15° C. | 0.8630 | 0.8715 | 0.8624 | 0.8548 |
| Total nitrogen, mg/L | 230 | 200 | 190 | — |
| Sulfur, wt % | 0.39 | 0.41 | 0.37 | 0.25 |
| Saturates, wt % | 61.7 | 58.0 | 58.4 | — |
| Aromatics, wt % | 38.3 | 42.0 | 41.6 | — |
| Cetane Number (D613) | 40.4 | 40.7 | 41.2 | 41.1 |

Comparative Background Example 1

This example shows that di-tert-butyl peroxide and tert-butyl perbenzoate are almost as effective as 2-ethylhexyl nitrate to increase cetane number of a diesel fuel. However, Compound I is significantly less effective when used by itself. The diesel fuel used in this example was MAP-2355 described above.

From the data is it apparent that the mixture of 2-ethylhexyl nitrate and the hydroperoxide quinone function as a synergistic combination because the improvement in cetane number is more than would be expected from a mere linear averaging of the contributions of each individual component.

| Cetane Improver | None | 2-Ethylhexyl Nitrate | Di-Tert-Butyl Peroxide | Tert-Butyl Perbenzoate | Compound I |
|---|---|---|---|---|---|
| Treat Rate, wt % | 0 | 0.3 | 0.3 | 0.3 | 0.3 |
| Cetane Number (D613) | 40.4 | 48.2 | 47.0 | 47.4 | 43.7 |

Example 1

This example illustrates the present synergistic cetane improver composition. Other oxygenated molecules such as tetrahydrofuran, trioxane and some glycols did not give a synergistic composition (see Example 6). The tert-butyl perbenzoate and 2-ethylhexyl nitrate mixture did not give significantly better cetane number increase than using either additive on its own, no synergism was demonstrated. The diesel fuel used in this example was MAP-2355, described above.

| Additive Composition | Cetane Number (D613) | Ignition Delay, msec |
|---|---|---|
| None | 40.4 | 6.4 |
| 0.3 wt % 2-ethylhexyl nitrate | 48.2 | 5.3 |
| 0.06 wt % tetrahydrofuran + 0.24 wt % 2-ethylhexyl nitrate | 45.3 | 4.6 |
| 0.06 wt % 2-(2-butoxyethoxy) ethanol 0.24 wt % 2-ethylhexyl nitrate | 46.0 | 4.8 |
| 0.06 wt % trioxane + 0.24 wt % 2-ethylhexyl nitrate | 46.6 | 5.5 |
| 0.06 wt % tetraethylene glycol dimethyl ether 0.24 wt % 2-ethylhexyl nitrate | 46.0 | 5.1 |
| 0.06 wt % tert-butyl perbenzoate 0.24 wt % 2-ethylhexyl nitrate | 48.7 | 4.5 |
| 0.06 wt % Compound I 0.24 wt % 2-ethylhexyl nitrate | 48.1 | 4.9 |
| 0.06 wt % di-tert-butyl peroxide 0.24 wt % 2-ethylhexyl nitrate | 47.4 | |

It is interesting to note that di-tert-butyl peroxide, as shown in comparative background Example 1 is a potent cetane improver in its own right, but that the mixture of di-tert-butyl peroxide with 2-ethylhexyl nitrate did not exhibit a synergistic result.

Example 2

This example confirms that the Compound 1 and 2-ethylhexyl nitrate mixture has a relative effectiveness much greater than would be predicted from a mere linear averaging of the contributions which would be expected from each component based on their individual effectiveness as cetane improvers. The diesel fuel used in this Example was MAP-2355, described above.

| Additive Composition | Cetane Number (D613) |
|---|---|
| 0.24 wt % 2-ethylhexyl nitrate | 46.0 |
| 0.06 wt % Compound I + 0.24 wt % 2-ethylhexyl nitrate | 48.1 |
| 0.3 wt % 2-ethylhexyl nitrate | 48.2 |
| 0.3 wt % Compound I | 43.7 |

Example 3

This example shows that in some diesel fuels the synergistic effect is even greater than with 2-ethylhexyl nitrate alone. The ignition delay of the Compound I/2-ethylhexyl nitrate composition is also lower than that with 2-ethylhexyl nitrate alone. The diesel fuel used in this Example was MAP-2272, described above.

| Cetane Improver | | | | | |
|---|---|---|---|---|---|
| 2-ethylhexyl nitrate, wt % | 0 | 0.3 | 0.15 | 0.225 | 0 |
| Compound I, wt % | 0 | 0 | 0.15 | 0.075 | 0.3 |

-continued

| Properties | | | | | |
|---|---|---|---|---|---|
| Ignition Delay, msec | 7.4 | 6.4 | 6.2 | 6.0 | 6.5 |
| Cetane Number (D613) | 40.7 | 47.4 | 48.0 | 50.0 | 42.7 |

Example 4

At lower treat rate (0.1 wt %), the synergistic effect is also observed as the results obtained are not those predictable from a mere linear averaging of the individual contribution of each component. In this Example the diesel fuel used was MAP-2325, described above.

| Cetane Improver | | | | |
|---|---|---|---|---|
| 2-ethylhexyl nitrate, wt % | 0 | 0.1 | 0.095 | 0.09 |
| Compound I | 0 | 0 | 0.005 | 0.01 |
| Properties | | | | |
| Ignition Delay, msec | 6.9 | 6.2 | 6.1 | 6.2 |
| Cetane Number (D613) | 41.2 | 45.3 | 44.2 | 46.0 |

Example 5

This example shows that Compound I has no detrimental effect on the following diesel fuel properties. Moreover, Compound I gave directionally better accelerated stability results. In this Example the diesel fuel used was MAP-2700, described above.

-continued

| DIESEL MAP-3325 | |
|---|---|
| Cetane Number (D-613) | 43.1 |

Example 6

| Compound | Treat Rate, wt % | Cetane Number (D-613) | ΔCN |
|---|---|---|---|
| None | 0 | 43.1 | 0 |
| Trioxane | 0.3 | 42.9 | −0.2 |
| Tetrahydrofuran | 0.3 | 43.5 | +0.4 |
| 2-(2-butoxyethoxy) ethanol | 0.3 | 41.6 | −1.5 |
| Tetraethylene glycol Dimethyl ether | 0.3 | 42.3 | −0.8 |
| 2-Ethylhexyl nitrate | 0.3 | 48.6 | +5.5 |

It should be noted that cetane number measurement by the ASTM D-613 method has poor precision. Therefore, a variation of ±1 CN should not be considered significant.

What is claimed is:

1. A diesel or middle distillate fraction composition, excluding jet fuel fraction, of improved cetane number comprising said diesel or middle distillate fraction and a combination additive comprising a major amount of an alkyl nitrate wherein said nitrate is a $C_4$–$C_{16}$ paraffinic nitrate or mixture thereof and less than 50 wt % of a hydroperoxide quinone of the formula

| Sample | Base Diesel | Base Diesel + 0.3 wt % 2-ethylhexyl Nitrate | Base Diesel + 0.3 wt % Compound I | Base Diesel + 0.24 wt % 2-ethylhexyl nitrate + 0.06 wt % Compound I |
|---|---|---|---|---|
| Properties | | | | |
| Density @ 15° C. | 0.8548 | 0.8551 | 0.8551 | 0.8552 |
| Cloud Point, °C. | −19 | −19 | −19 | −19 |
| Pour Point, °C. | −24/−27 | −24/−27 | −24/−27 | −24/−27 |
| Flash Point, °C. | 69 | 69 | 69 | 69 |
| Haze, % T | 100 | 100 | 100 | 100 |
| Accelerated Stability 16 hours @ 95° C. | | | | |
| Total Insol. mg/100 ml | 0.86 | 0.83 | 0.72 | 0.78 |
| Initial Color | <1.0 | <1.0 | <1.0 | <1.0 |
| Final Color | <1.5 | <1.5 | <1.5 | <1.5 |

Example 6

This example shows that tetrahydrofuran, trioxane, 2-(2-butoxyethoxy) ethanol and tetraethylene glycol dimethyl ether are poor cetane improvers as compared to compounds in Example 1. In Example 6, diesel fuel MAP-3325 with the following properties has been used.

| DIESEL MAP-3325 | |
|---|---|
| Density @ 15° C. | 0.8523 |
| Total nitrogen, mg/L | 131 |
| Sulfur, wt % | 0.26 |
| Saturates, wt % | 66.9 |
| Aromatics, wt % | 33.1 |

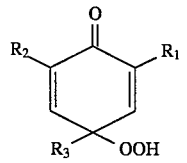

where $R_1$ and $R_2$ are tert-butyl and $R_3$ is methyl and wherein the combination additive is present in an amount in the range 0.05 to 3 wt % based on the diesel or middle distillate fraction.

2. The composition of claim 1 wherein the alkyl nitrate is butyl nitrate, amyl nitrate, hexyl nitrate, heptyl nitrate, octyl nitrate, their isomers and mixtures thereof.

3. The composition of claim 1 wherein the alkyl nitrate is 2-ethylhexyl nitrate.

4. The composition of claim 1, 2, or 3 wherein the additive is present in an amount in the range 0.1 to 2.0 wt %.

5. The composition of claim 1, 2, or 3 wherein the hydroperoxide quinone comprises 0.5 to 25 wt % of the combination additive.

6. The composition of claim 4 wherein the hydroperoxide quinone comprises 0.5 to 25 wt % of the combination additive.

7. An additive composition for improving the cetane number of diesel fuel or other middle distillate fraction, excluding jet, comprising a major amount of an alkyl nitrate wherein said nitrate is a $C_4$–$C_{16}$ paraffinic nitrate or mixture thereof and less than 50 wt % of a hydroperoxide quinone of the formula:

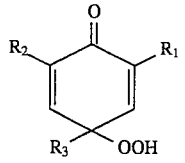

wherein $R_1$ and $R_2$ are tert-butyl and $R_3$ is methyl.

8. The additive composition of claim 7 wherein the alkyl nitrate is 2-ethylhexyl nitrate.

9. The additive composition of claim 7 or 8 wherein the hydroperoxide quinone comprises 0.5 to 25 wt % of the additive composition.

* * * * *